US006511522B1

(12) United States Patent
Gomez et al.

(10) Patent No.: US 6,511,522 B1
(45) Date of Patent: Jan. 28, 2003

(54) QUICK CONNECT, STABILIZED CLEAN ROOM FILTER SUPPORT SYSTEM

(75) Inventors: Tony Gomez, Anaheim, CA (US); Matthew Wharton, Anaheim, CA (US); Richard Braman, Anaheim, CA (US)

(73) Assignee: HEPA Corporation, Anaheim, CA (US)

( * ) Notice: Subject to any disclaimer, the term of this patent is extended or adjusted under 35 U.S.C. 154(b) by 0 days.

(21) Appl. No.: 09/815,889

(22) Filed: Mar. 23, 2001

Related U.S. Application Data

(60) Provisional application No. 60/275,142, filed on Mar. 9, 2001.

(51) Int. Cl.[7] ..... E04B 9/02; E04B 9/06

(52) U.S. Cl. ..... 55/385.2; 55/508; 55/DIG. 18; 55/DIG. 46; 52/506.05; 52/506.09; 52/302.1; 52/511; 454/187; 454/292

(58) Field of Search ..... 55/385.2, 422, 55/418, 480, 484, 504, 508; 454/187, 292; 52/506.05, 506.09, 302.1, 511

(56) References Cited

U.S. PATENT DOCUMENTS 5,192,348 A * 3/1993 Wawig ..... 55/385.2
5,279,632 A * 1/1994 Decker et al. ..... 55/385.2
5,417,610 A * 5/1995 Spransy ..... 454/187
5,613,759 A * 3/1997 Ludwig et al. ..... 55/385.2
5,865,674 A * 2/1999 Starr ..... 454/187
5,993,519 A * 11/1999 Lim et al. ..... 454/187
6,070,383 A * 6/2000 Jeanseau ..... 454/187
6,267,793 B1 * 7/2001 Gomez et al. ..... 454/187
6,270,546 B1 * 8/2001 Jeanseau et al. ..... 454/187

* cited by examiner

*Primary Examiner*—David A. Simmons
*Assistant Examiner*—Minh-Chan T. Pham
(74) *Attorney, Agent, or Firm*—Louis J. Bachand

(57) ABSTRACT

A clean room filter support system has a filter unit comprising a perimetrical frame having four sides of a predetermined vertical extent with upper and lower edges and filtering material held within the frame for air flow between a first plane incorporating rear face of the filter material and a second plane incorporating a front face of the filter material, at least one side of the perimetrical frame defines an outwardly projecting bracket. There is a connector extending vertically between the support surface and the filter unit frame that has a rod supported from the support surface and an anchor structure supported by the rod. A spring-loaded pin engages with the bracket and is adjustable to selectively engage the anchor structure to couple the filter unit by its bracket to the anchor structure, the pin being adjustable for selectively engaging the anchor structure. A clip interposed between the pin head and the bracket blocks shifting of the filter unit against the resiliency of the spring.

23 Claims, 2 Drawing Sheets

QUICK CONNECT, STABILIZED CLEAN ROOM FILTER SUPPORT SYSTEM

CROSS-REFERENCE TO RELATED APPLICATIONS

This application claims the benefit of U.S. Provisional Application Ser. No. 60/275,142, filed Mar. 9, 2001.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to clean rooms and to the arrays of filters used in clean rooms and like spaces where ultra-pure air is required. More particularly, the invention relates to improvements in the mounting of filter units in clean room filter arrays. In a specific embodiment, the invention provides a quick-connect mounting for filter units using a common anchor array for supporting spring-loaded retaining pins supporting the filter units, a series of outwardly projecting brackets that engage the pins, and in preferred embodiments stabilizing clips to block unwanted movement of spring fastener-mounted filter units by selectively rigidly spacing the pin heads and the bracket.

2. Description of the Related Art

Filter unit support in clean rooms has frequently involved grids of support members that may contain sealing gels. More recently, filter units have been supported in small groups or individually. See U.S. Pat. Nos. 3,350,862, 3,360, 910, 3,780, 503, 3,808,777, 4,178,159, 4,239,109, 4,601, 737, 4,883,511, 5,329,739, 5,454,756, 5,871,556, 5,946,875, 6,070,383, 6,183,528, 6,190,431, DE 3719734 and DE 3836147, Certain of such systems have involved special hardware requirements that have proved costly. Lower cost installations with ready filter interchange capability are always in demand and there is thus a need for a simplified filter unit support system.

BRIEF SUMMARY OF THE INVENTION

Further, the use in some systems of spring loaded pins to maintain the filter units in place sometimes permits movement of the filter under force from above such as walking person atop the filter array, or earthquake disturbances. This movement, while permitted by the spring mounting of the filter units, is undesirable as the sealing between adjacent filters, critical to the integrity of the clean room, may be compromised by the movement.

It is an object, therefore, of the present invention to provide an improved clean room ceiling filter array support system. It is a further object to provide filter units having on their sides projecting brackets that receive mounting pins. Another object is to provide an overhead anchor structure that is slotted to receive transverse members in pin mounting relation to support the filter units by the pins that engage the unit brackets. Yet another object is to provide for the adjustment, vertically, rotationally, etc. of the pins from within the clean room, from below the filter units, at pin heads that are accessible from the within the clean room, i.e. there are downwardly available heads on the pins. A further object is to provide a clip that engages between the pin head and the bracket to remove the springiness in the filter unit mounting and stabilize the system against shifting of the units.

These and other objects of the invention to become apparent hereinafter are realized in a clean room filter support system for supporting a clean room filter unit in spaced relation to a support surface bordering a clean room, the filter unit comprising a perimetrical frame having four sides of a predetermined vertical extent with upper and lower edges and filtering material held within the frame for air flow between a first plane incorporating rear face of the filter material and a second plane incorporating a front face of the filter material, at least one side of the perimetrical frame defining an outwardly projecting bracket between the one side upper and lower edges, a connector extending vertically between the support surface and the filter unit frame, the connector comprising a rod supported from the support surface and an anchor structure supported by the rod, a pin engaged with the bracket and adjustable to selectively engage the anchor structure to couple the filter unit by its the bracket to the anchor structure, the pin being adjustable for selectively engaging the anchor structure.

In this and like embodiments, typically, the pin is accessible for adjustment from within the clean room and the frame is formed of metal, the outwardly projecting bracket is integrally formed with the side wall, the outwardly projecting bracket is spaced from each of the first and second planes, the pin is a component of a pin and spring assembly disposed generally parallel to the one side and perpendicular to the bracket, the pin penetrating the bracket in engaging relation, the assembly pin has a head facing the second plane, the pin head has a shoulder facing the first plane, the spring being centered on the pin with its lower end blocked against the shoulder and its upper end blocked against the bracket to resiliently urge the pin from the bracket, the pin has a locking member on the opposite side of the bracket from the spring that locks the pin against exiting from the bracket against the urging of the spring, the pin has a continued extent above the bracket extending to the anchor structure, and there are cooperating fasteners on the pin continued extent and the anchor structure to anchor the pin in place, the cooperating fasteners comprise opposed flanges on the anchor structure spaced across a slot, and an upper transverse member carried by the pin continued extent arranged to pass through the slot in one adjustment of the pin and to engage the flanges in a second adjustment of the pin to support the pin in place against the weight of the filter unit, the pin further comprises a lower transverse member engaged in detented relation with the bracket to maintain the second adjustment of the pin in the anchor structure, the filter unit is shiftable downwardly relative to the pin against the urging of the spring on the bracket, and in certain embodiments there is also a clip rigidly engaged between the bracket and the shoulder to block downward shifting of the filter unit; and, the clip comprises a generally U-shaped member with left and right legs and a cross-piece joining the legs at one end thereof, the member cross-piece being engaged with the bracket and journaled on the pin, the legs having opposed upsets arranged to receive and rigidly engage the pin head against shifting of the filter unit against the urging of the spring at the bracket, the legs being outwardly deflectable in pin head disengaging relation to free the pin for adjustment.

In a further embodiment, the invention provides a clean room filter support system for supporting a clean room filter unit in spaced relation to a support surface, the filter unit comprising a perimetrical frame having four sides of a predetermined vertical extent with upper and lower edges and filtering material held within the frame for air flow between a first plane incorporating rear face of the filter material and a second plane incorporating a front face of the filter material, at least two opposed sides of the perimetrical frame defining outwardly projecting brackets between and spaced from each of the first and second planes, a connector extending vertically between the support surface and the filter unit frame, the connector comprising a rod supported from the support surface and an anchor structure supported by the rod, a headed pin and spring assembly at each bracket, the assembly being generally parallel to its adjacent frame side and engaged with the bracket and bodily adjustable to selectively engage the anchor structure to couple the filter unit by its the brackets to the anchor structure, the assembly resiliently connecting the connector to the bracket shiftably against the spring to support the filter frame on the connector, each the assembly pin being bodily adjustable for selectively engaging the anchor structure.

In this and like embodiments, typically, each the outwardly projecting bracket is integrally formed with its respective side wall, each outwardly projecting bracket is intermediate its frame upper and lower edges, each pin and spring assembly is disposed generally perpendicular to the bracket, each pin penetrating the bracket in engaging relation, each assembly pin head faces the second plane, each pin head having a shoulder facing the first plane, each spring being centered on its pin with its lower end blocked against the shoulder and its upper end blocked against the bracket to resiliently urge the pin from the bracket, each pin having a locking member on the opposite side of the bracket from the spring that locks the pin against exiting from the bracket against the urging of the spring, the pin having a continued extent above the bracket extending to the anchor structure, and cooperating fasteners on the pin continued extent and the anchor structure to anchor the pin in place.

Further, typically, the cooperating fasteners comprise opposed flanges on the anchor structure spaced across a slot, and there is an upper transverse member carried by the pin continued extent arranged to pass through the slot in one adjustment of the pin and to engage the flanges in a second adjustment of the pin to support the pin in place against the weight of the filter unit, each pin further comprises a lower transverse member engaged in detented relation with its respective bracket to maintain the second adjustment of the pin in the anchor structure, the filter unit is shiftable downwardly relative to each the pin against the urging of the spring on the bracket, and including also a clip rigidly engaged between each the bracket and shoulder to block downward shifting of the filter unit, the clip comprises a generally U-shaped member with left and right legs and a cross-piece joining the legs at their opposed ends, the cross-piece being engaged with its bracket and centered or journaled on its pin, the legs having opposed upsets arranged to receive and rigidly engage the pin head shoulder against shifting of the filter unit against the urging of the spring at the bracket, the legs being outwardly deflectable in pin head disengaging relation to free the pin for adjustment.

In a particular embodiment, the invention provides a clip adapted for centering on a headed retaining pin and engagement between a filter unit frame bracket and pin head, the clip comprising a generally U-shaped member of resilient material with left and right legs and a cross-piece joining the legs at opposed ends thereof, the cross-piece defining an opening that passes the pin and engages the bracket, the legs having opposed upsets arranged to receive and rigidly engage the pin head against shifting of the filter unit against the urging of the spring at the bracket, the legs being outwardly deflectable in pin head disengaging relation to free the pin for adjustment relative to the clip.

In a further particular embodiment, the invention provides a filter unit comprising a four-sided frame, at least one side of the frame having a projecting bracket that is apertured to pass a retaining pin.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 1:
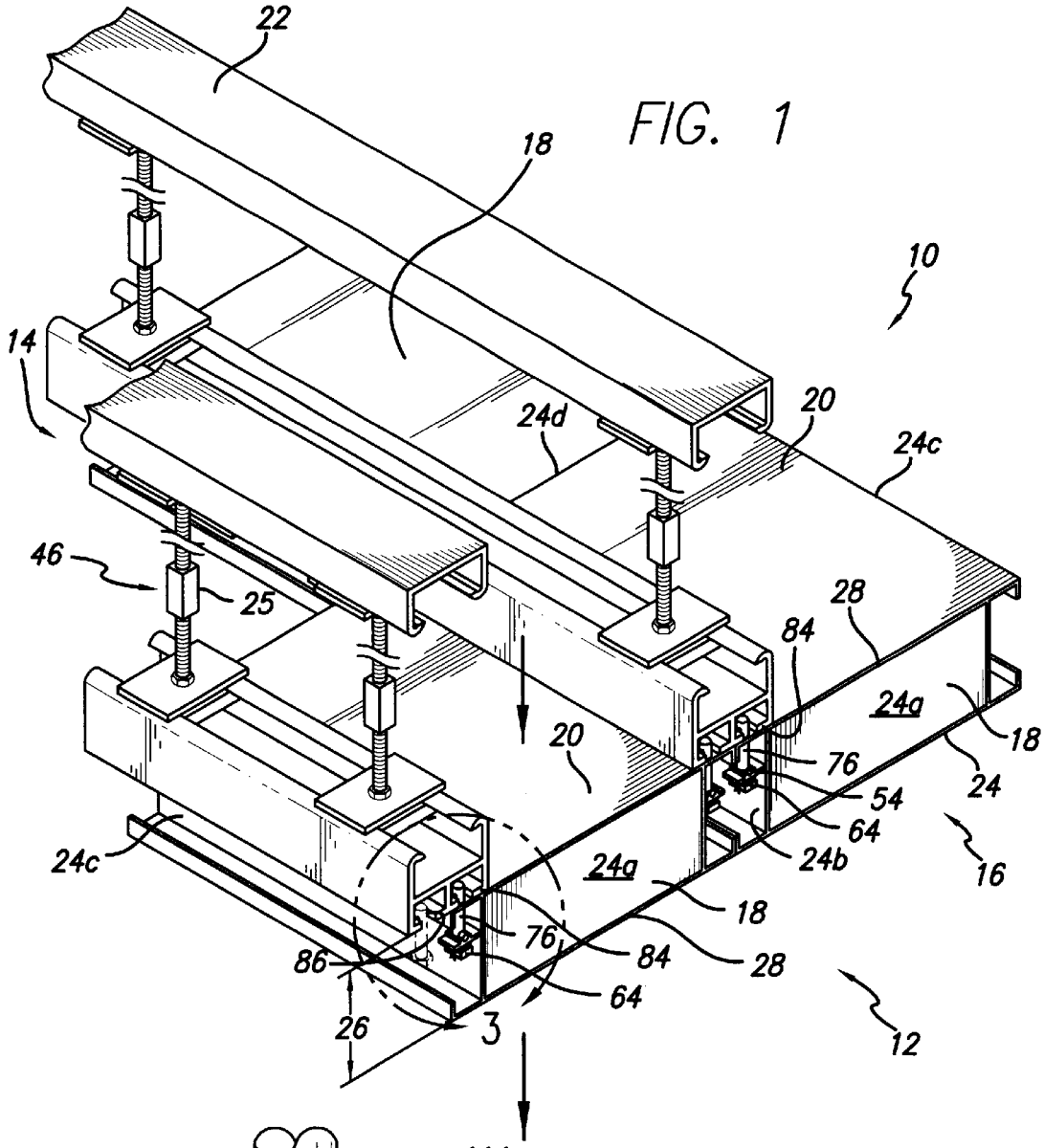
FIG. 1 is an oblique view of the clean room filter array support system according to the invention.
Figure 4:
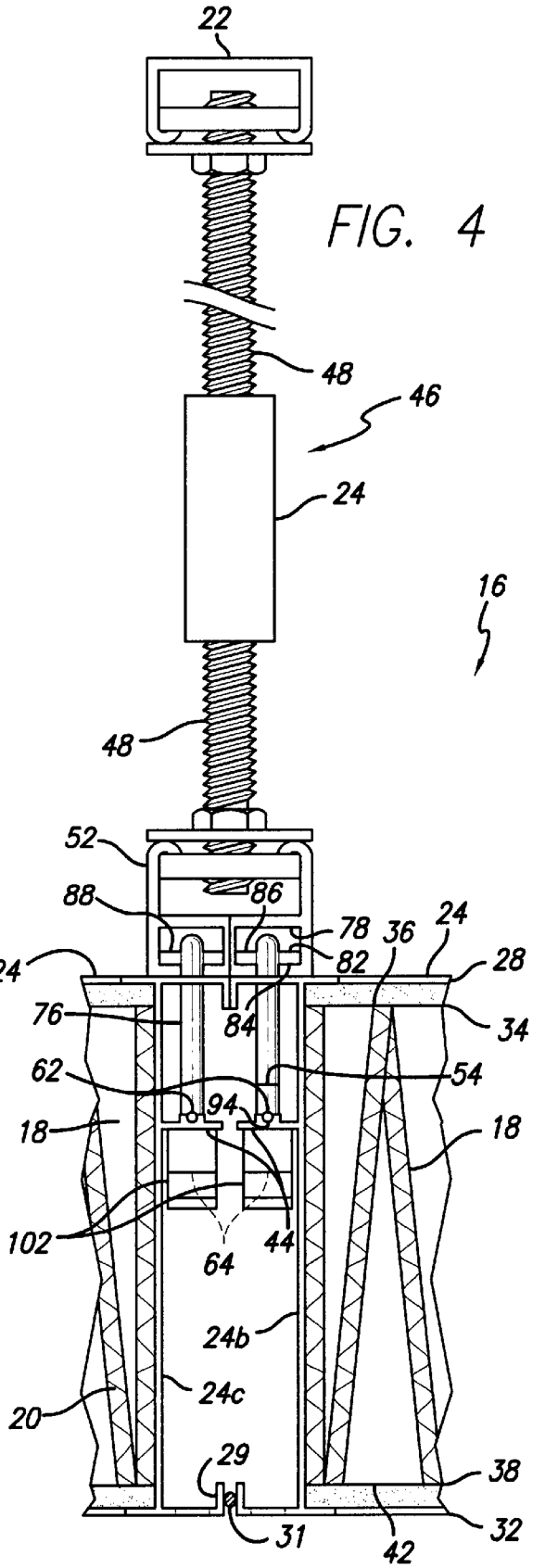
FIG. 4 is a view like FIG. 3 of the support system in detail.

With reference now to the drawings in detail, in FIGS. 1 and 4 the invention is shown at 10 to comprise in a clean room indicated at 12 a filter support system 14 for supporting an array 16 of clean room filter units 18 in spaced relation to a support 22 that is fixed to the true or a false ceiling (not shown) in the building housing the clean room. Support system includes connectors 46 comprising rods 48 that are length-adjustable by turnbuckle 25.

Each filter unit 18 comprises a rectangular perimetrical frame 24 having four straight sides 24*a*, 24*b*, 24*c* and 24*d*, each of a common predetermined vertical extent 26 and with upper and lower edges 28, 32. lower edges 28 have a flange 29. Opposing flanges 29 are sealed by seal 31, such as caulking, T-members or gaskets, against air flow between units 18.

Filtering material 20 of the HEPA, ULPA or other high efficiency type is held within the frame 24 for air flow, indicated by the arrows, between a first plane 34 incorporating rear face 36 of the filter material and a second plane 38 incorporating a front face 42 of the filter material, FIG. 4. At least one and preferably two opposed sides 24*b*, 24*c*, of the perimetrical frame 24 define outwardly projecting brackets 44 between and spaced from each of the first and second planes 34, 38.

Figure 3:
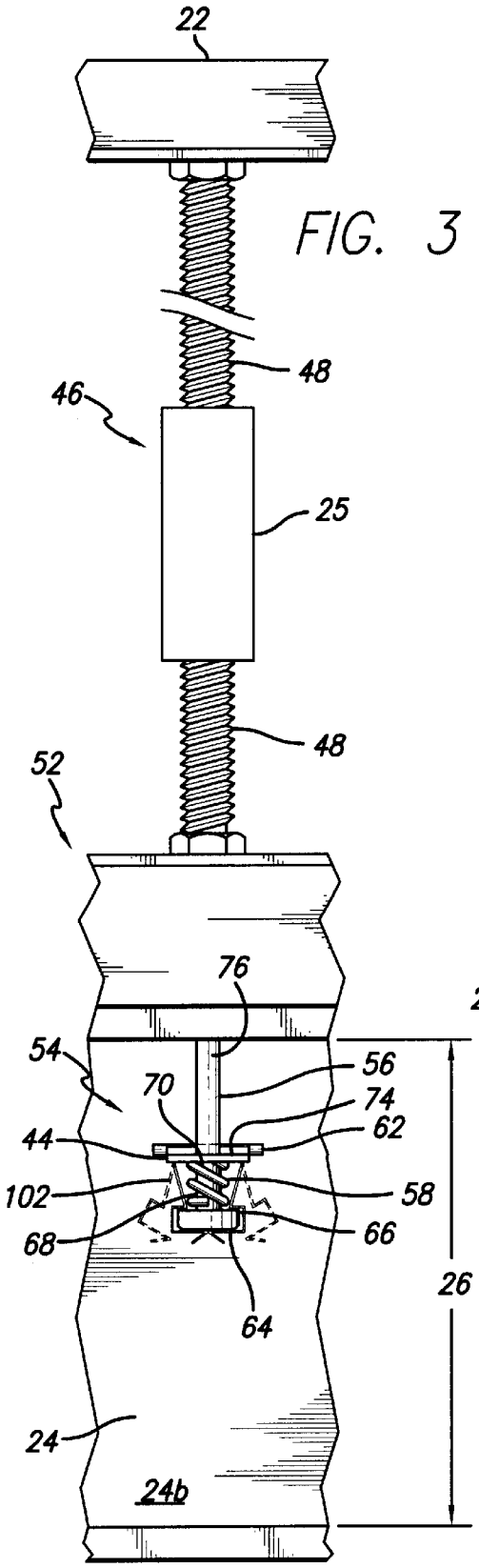
FIG. 3 is a fragmentary view of the support system taken on line 3 in FIG. 1 and showing particularly the clip alternately in its closed and deflected condition.

Connectors 46 extend vertically between the support surface 22 and the filter unit frame 24. Each connector 46 of rod 48 and turnbuckle 25 is supported from the support surface 22 and further comprises an anchor structure 52 supported by the rod. A pin retaining assembly 54 comprising headed pin 56 and compression spring 58 are located at each bracket 44 (FIG. 3). Assembly 54 is generally parallel to its adjacent frame side, e.g. 24*b* and engaged with the bracket 44 as shown. Assembly 54 is bodily adjustable by rotation, vertical shifting, etc. to selectively engage the anchor structure 52 to couple the filter unit 18 by its brackets 44 to the anchor structure. Assembly 54 resiliently connects the connector 46 to the bracket 44 shiftably against the spring 58 to support the filter frame 24 on the connector. Each assembly pin 56 is separately bodily adjustable for selectively engaging the anchor structure 52. This adjustment is performed from within the room 12 using a suitable tool, such as an Allen wrench (not shown) to engage the pin head 64.

Preferably, each outwardly projecting bracket 44 is integrally formed with its respective side wall, e.g. 24*b*, and is preferably located intermediate the frame upper and lower edges 28, 32. As shown, each pin and spring assembly 54 is disposed generally perpendicular to the bracket 44, with each pin 56 penetrating the bracket in engaging relation through the transverse member 62 as hereinafter described. Each assembly pin head 64 faces the second plane 38 and has a shoulder 66 that faces the first plane 34. Each spring 58 is centered on its pin 56 with its lower end 68 blocked against the shoulder 66 and its upper end 70 blocked against the bracket 44 to resiliently urge the pin from the bracket. Each pin 56 has a locking transverse member 62 on the opposite side of the bracket 44 from the spring 58 that locks the pin against exiting from the bracket aperture 74 against the urging of the spring. Pin 56 further has a continued extent 76 above the bracket 44 and extending to the anchor structure 52. Cooperating fasteners 78, 82 are provided on the pin continued extent 76 and the anchor structure 52 to anchor the pin 56 in place.

The cooperating fasteners 78, 82 are shown in this embodiment to comprise opposed flanges 84 on the anchor structure 52 spaced across a slot 86, and an upper transverse member 88 carried by the pin continued extent 76. Transverse member 88 is arranged to pass through the slot 86 in one rotational adjustment of the pin (using a tool not shown) that engages the pin head 64 from below the filter array 16, to engage the flanges 84 in a second adjustment of the pin 56 to support the pin in place against the weight of the filter unit 18.

Each pin 56 further comprises the lower transverse member 62 engaged in detented relation, as shown by the nesting of the member in the detent recess 94 in FIG. 4, with its respective bracket 44 to maintain the second adjustment of the pin 56 in the anchor structure 52.

In practice, as thus far described the filter unit support assembly 54 may permit shifting toward the room 12 if a force is applied to the filter unit 18. This occurs because the spring 58 may compress upon a force being applied from above to the filter unit 18, e.g. from a person walking above the filter units, or from an earthquake or other perturbation. Thus, filter unit 18 is shiftable downwardly relative to each pin 56 against the urging of the spring 58 on the bracket 44. This movement can be blocked by rigidly mounting the filter units 18, but such an installation is problematical since secure fastening is burdensome and the quick-assembly, quick-removal feature of the invention is compromised if there is not a resilient mounting such as afforded by the spring 58.

The invention provides a way to stiffen the mounting and thereby stabilize the filter unit 18 against this shifting after the initial installation of the filters while retaining the spring 58. This is accomplished by adding a support to block the action of spring 58, after installation of the filter units. This support is readily disengaged when unit 18 removal is needed, and can be bypassed to reach pin head 64 to adjust the pin 56.

Figure 2:
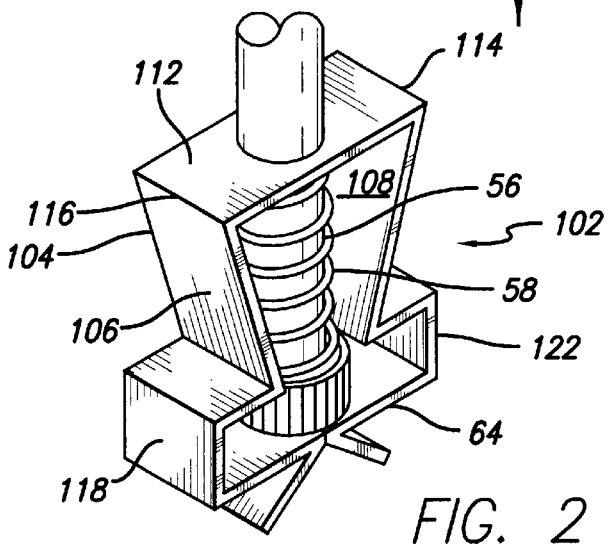
FIG. 2 is an oblique view of the stabilizing clip and spring-pin assembly of the invention.

With reference to FIGS. 2 and 3, clip 102 is shown adapted to be rigidly engaged (when in a closed condition) between each bracket 44 and pin head shoulder 66 to block downward shifting of the filter unit 18. Clip 102 comprises a generally U-shaped member 104 with left and right legs 106, 108 and a cross-piece 112 joining the legs at their opposed ends 114, 116. Cross-piece 112 is engaged with its bracket 44 and centered or journaled on its pin 56. Legs 106, 108 have opposed upsets 118, 122 arranged to receive the pin head 64 and rigidly engage the pin head shoulder 66 against shifting of the filter unit 18 against the urging of the spring 58 at the bracket 44. To open the clip 102 from its closed condition to an open condition, legs 106, 108 are outwardly deflectable in pin head 64 disengaging relation to free the pin for adjustment. See the dotted lines in FIG. 3.

The invention thus provides an improved clean room ceiling filter array support system in which filter units have on their sides projecting brackets that receive mounting pins for coupling to an overhead anchor structure that is slotted to receive transverse members in pin mounting relation to support the filter units by the pins that engage the unit brackets. The pins are adjustable vertically, rotationally, etc. from below the filter units at downwardly available heads on the pins. A clip is provided that engages between the pin head and the bracket to remove the springiness in the filter unit mounting and stabilize the system against shifting of the units.

The foregoing objects are thus met.

We claim:

1. A clean room filter support system for supporting a clean room filter unit in spaced relation to a support surface, said filter unit comprising a perimetrical frame having four sides with upper and lower edges and filtering material held within said frame for air flow between a first plane incorporating a rear face of said filter material and a second plane incorporating a front face of said filter material, at least one side of said perimetrical frame defining an outwardly projecting bracket between and spaced from said upper and lower edges, a connector extending vertically between said support surface and said filter unit frame, said connector comprising a rod supported from said support surface and an anchor structure supported by said rod, a pin engaged with said bracket, said pin being adjustable to selectively engage said anchor structure to couple said filter unit by said bracket to said anchor structure.

2. The clean room filter support system according to claim 1, in which said frame is formed of metal.

3. A clean room filter support system for supporting a clean room filter unit in spaced relation to a support surface, said filter unit comprising a perimetrical frame having four sides with upper and lower edges and filtering material held within said frame for air flow between a first plane incorporating a rear face of said filter material and a second plane incorporating a front face of said filter material, at least one side of said perimetrical frame defining an outwardly projecting bracket between said one side upper and lower edges, said outwardly projecting bracket being integrally formed with said side wall, a connector extending vertically between said support surface and said filter unit frame, said connector comprising a rod supported from said support surface and an anchor structure supported by said rod, a pin engaged with said bracket, said pin being adjustable to selectively engage said anchor structure to couple said filter unit by its said bracket to said anchor structure.

4. A clean room filter support system for supporting a clean room filter unit in spaced relation to a support surface, said filter unit comprising a perimetrical frame having four sides with upper and lower edges and filtering material hold within said frame for air flow between a first plane incorporating a rear face of said filter material and a second plane incorporating a front face of said filter material, at least one side of said perimetrical frame defining an outwardly projecting bracket between said one side upper and lower edges, said outwardly projecting bracket being spaced from each of said first and second planes, a connector extending vertically between said support surface and said filter unit frame, said connector comprising a rod supported from said support surface and an anchor structure supported by said rod, a pin engaged with said bracket, said pin being adjustable to selectively engage said anchor structure to couple said filter unit by its said bracket to said anchor structure.

5. A clean room filter support system for supporting a clean room filter unit in spaced relation to a support surface, said filter unit comprising a perimetrical frame having four sides with upper and lower edges and filtering material held within said frame for air flow between a first plane incorporating a rear face of said filter material and a second plane incorporating a front face of said filter material, at least one side of said perimetrical frame defining an outwardly projecting bracket between said one side upper and lower edges, a connector extending vertically between said support surface and said filter unit frame, said connector comprising a rod supported from said support surface and an anchor structure supported by said rod, a pin engaged with said bracket, said pin being adjustable to selectively engage said anchor structure to couple said filter unit by its said bracket to said anchor structure, said pin being a component of a pin and spring assembly disposed generally parallel to said one side and perpendicular to said bracket, said pin penetrating said bracket in engaging relation.

6. The clean room filter support system according to claim 5, in which said assembly pin has a head facing second plane, said pin head having a shoulder facing said first plane, said spring being centered on said pin and having a lower end blocked against said shoulder and an upper end blocked against said bracket to resiliently urge said pin from said bracket, said pin having a locking member on the opposite side of said bracket from said spring that locks said pin against exiting from said bracket against the urging of said spring, said pin having a continued extent above said bracket extending to said anchor structure, and cooperating fasteners on said pin continued extent and said and said anchor structure to anchor said pin in place.

7. The clean room filter support system according to claim 6, in which said cooperating fasteners comprise opposed flanges on said anchor structure spaced across a slot, and an upper transverse member carried by said pin continued extent arranged to pass through said slot in one adjustment of said pin and to engage said flanges in a second adjustment of said pin to support said pin in place against the weight of said filter unit.

8. The filter unit support system according to claim 7, in which said pin further comprises a lower transverse member engaged in detented relation with said bracket to maintain the second adjustment of said pin in said anchor structure.

9. The clean room filter support system according to claim 8, in which said filter unit is shiftable downwardly relative to said pin against the urging of said spring on said bracket, and including also a clip rigidly engaged between said bracket and said shoulder to block downward shifting of said filter unit.

10. The clean room filter support system according to claim 9, in which said clip comprises a generally U-shaped member with left and right legs and a cross-piece joining said legs at one end thereof, said member cross-piece being engaged with said bracket and journaled on said pin, said legs having opposed upsets arranged to receive and rigidly engage said pin head against shifting of said filter unit against the urging of said spring at said bracket, said legs being outwardly deflectable in pin head disengaging relation to free said pin for adjustment.

11. clean room filter support system for supporting a clean room filter unit in spaced relation to a support surface, said filter unit comprising a perimetrical frame having four sides with upper and lower edges and filtering material held within said frame for air flow between a first plane incorporating a rear face of said filter material and a second plane incorporating a front face of said filter material, at least two opposed sides of said perimetrical frame defining outwardly projecting brackets between and spaced from each of said first and second planes, a connector extending vertically between said support surface and said filter unit frame, said connector comprising a rod supported from said support surface and an anchor structure supported by said rod, a headed pin and spring assembly at each said bracket, said assembly being generally parallel to the frame side adjacent thereto and engaged with said bracket and bodily adjustable to selectively engage said anchor structure to couple said filter unit by said brackets to said anchor structure, said assembly resiliently connecting said connector to said bracket shiftably against said spring to support said filter frame on said connector, each said assembly pin being bodily adjustable for selectively engaging said anchor structure.

12. A clean room filter support system for supporting a clean room filter unit in spaced relation to a support surface, said filter unit comprising a perimetrical frame having four sides with upper and lower edges and filtering material held within said frame for air flow between a first plane incorporating a rear face of said filter material and a second plane incorporating a front face of said filter material, at least two opposed sides of said perimetrical frame defining outwardly projecting brackets between and spaced from each of said first and second planes, a connector extending vertically between said support surface and said filter unit frame, said connector comprising a rod supported from said support surface and an anchor structure supported by said rod, a headed pin and spring assembly at each said bracket, each said outwardly projecting bracket being integrally formed with the respective side wall of said bracket, said assembly being generally parallel to adjacent frame side and engaged with said bracket and bodily adjustable to selectively engage said anchor structure to couple said filter unit by said brackets to said anchor structure, said assembly resiliently connecting said connector to said bracket shiftably against said spring to support said filter frame on said connector, each said assembly pin being bodily adjustable for selectively engaging said anchor structure.

13. The clean room filter support system according to claim 12, in which each said outwardly projecting bracket is intermediate the upper and lower edges of the frame from which it projects.

14. The clean room filter support system according to claim 13, in which each said pin and spring assembly is disposed generally perpendicular to said bracket, each said pin penetrating said bracket in engaging relation.

15. The clean room filter support system according to claim 14, in which each said assembly pin head faces said second plane, each said pin head having a shoulder facing said first plane, each said spring being centered on said pin with a lower end blocked against said shoulder and an upper end blocked against said bracket to resiliently urge said pin from said bracket, each said pin having a locking member on the opposite side of said bracket from said spring that locks said pin against exiting from said bracket against the urging of said spring, said pin having a continued extent above said bracket extending to said anchor structure, and cooperating fasteners on said pin continued extent and said and said anchor structure to anchor said pin in place.

16. The clean room filter support system according to claim 15, in which said cooperating fasteners comprise opposed flanges on said anchor structure spaced across a slot, and an upper transverse member carried by said pin continued extent arranged to pass through said slot in one adjustment of said pin and to engage said flanges in a second adjustment of said pin to support said pin in place against the weight of said filter unit.

17. The filter unit support system according to claim 16, in which each said pin further comprises a lower transverse member engaged in detented relation with its respective bracket to maintain the second adjustment of said pin in said anchor structure.

18. The clean room filter support system according to claim 17, in which said filter unit is shiftable downwardly relative to each said pin against the urging of said spring on said bracket, and including also a clip rigidly engaged between each said bracket and shoulder to block downward shifting of said filter unit.

19. The clean room filter support system according to claim 18, in which said clip comprises a generally U-shaped member with left and right legs and a cross-piece joining said legs at one end thereof, said cross-piece being engaged with its said bracket and journaled on said pin, said legs having opposed upsets arranged to receive and rigidly engage said pin head shoulder against shifting of said filter unit against the urging of said spring at said bracket, said legs being outwardly deflectable in pin head disengaging relation to free said pin for adjustment.

20. A clip adapted for centering on a headed retaining pin and engagement between a filter unit frame bracket and pin head, said clip comprising a generally U-shaped member of resilient material with left and right legs and a cross-piece joining said legs at opposed ends thereof, said cross-piece defining an opening that passes said pin and engages said bracket, said legs having opposed upsets arranged to receive and rigidly engage said pin head against shifting of said filter unit against the urging of said spring at said bracket, said legs being outwardly deflectable in pin head disengaging relation to free said pin for adjustment relative to said clip.

21. A filter unit comprising a four-sided frame, at least one side of said frame having an outwardly projecting bracket, said bracket being apertured, and a retaining pin in said aperture.

22. A filter unit comprising a four-sided frame, at least two sides of said frame each having an outwardly projecting bracket, said bracket being apertured to pass a retaining pin, and a retaining pin in said bracket aperture.

23. In combination: A filter unit comprising a four-sided frame, at least one side of said frame having a projecting bracket that is apertured to pass a retaining pin and a retaining pin and spring assembly in which said spring is centered on said pin, said bracket aperture being adapted to pass said retaining pin while blocking passage of said spring.

* * * * *